US006116049A

United States Patent [19]

Filipczak

[11] Patent Number: 6,116,049

[45] Date of Patent: Sep. 12, 2000

[54] ADIABATIC EXPANSION NOZZLE

[75] Inventor: Robert A. Filipczak, Linwood, N.J.

[73] Assignee: The United States of America as represented by the Secretary of Transportation, Washington, D.C.

[21] Appl. No.: 09/190,210

[22] Filed: Nov. 13, 1998

[51] Int. Cl.[7] ..... F25J 3/02

[52] U.S. Cl. ..... 62/603; 62/51.2; 62/910

[58] Field of Search ..... 62/910, 603, 51.2

[56] References Cited

U.S. PATENT DOCUMENTS

| | | | |
|---|---|---|---|
| 3,257,823 | 6/1966 | Hogan | 62/51.2 |
| 3,306,058 | 2/1967 | Keiln | 62/51.1 |
| 3,492,829 | 2/1970 | Stanford, Jr. | 62/603 |
| 3,706,520 | 12/1972 | Grimm et al. | 239/423 |

FOREIGN PATENT DOCUMENTS

| | | | |
|---|---|---|---|
| 304958 | 1/1929 | United Kingdom | 62/603 |
| WO 87/04776 | 8/1987 | WIPO . | |

*Primary Examiner*—Ronald Capossela

*Attorney, Agent, or Firm*—Otto M. Wildensteiner

[57] ABSTRACT

A nozzle for producing a continuous gas/solid or gas/aerosol stream from a liquid having a high room temperature vapor pressure. The nozzle comprises a series of expansion stages, with the flow reversing direction after each expansion except the first and going over the conduit which comprised the previous expansion stage. In addition, the flow from the last expansion stage comes in contact with the inlet conduit, thereby exposing the inlet flow to the cold temperature produced in the nozzle. Since the flow in the nozzle is essentially adiabatic, the expansion in each stage takes heat from the flow in the previous stage, ultimately resulting in very low temperature flow. It is particularly useful as a fire extinguisher since it can produce solid $CO_2$ snow and an aerosol of HFC-23 that are "thrown" by the remaining gaseous $CO_2$ and HFC-23 at low exit velocities. This means that these agents can be used on Class A fires. A test nozzle using 1 liter (2.14 pounds) of HFC-23 demonstrated equivalency to a 2½ pound Halon 1211 fire extinguisher as determined by the FAA/JRC Hidden Fire Test Protocol for hand-held extinguishers.

22 Claims, 7 Drawing Sheets

ADIABATIC EXPANSION NOZZLE

STATEMENT OF GOVERNMENT INTEREST

The present invention may be made or used by or for the Government of the United States without the payment of any royalties thereon or therefor.

BACKGROUND

There are many compounds that have suitable fire-extinguishing properties but which cannot be used in fire extinguishers for use on Class A fires (i.e. paper and wood) because their exit velocities from the extinguisher nozzle are too high. These compounds have in common the fact that they have very high vapor pressures at room temperature (i.e. 500–800 psi). They are stored in a fire extinguisher as a liquid, and when directed at a fire the liquid comes out of the nozzle as a gas at a very high velocity.

Liquid carbon dioxide is one of these compounds. Carbon dioxide is well known for putting out fires, but the exit velocity from a prior art nozzle is so high that burning paper and small pieces of wood are blown about and scattered rather than being extinguished. This propagates, rather than extinguishes, the fire. Even when some of the $CO_2$ is converted to "snow" the exit velocity from prior art nozzles is still too high to be used on paper or wood fires.

Another compound with the same undesirable exit velocity is HFC-23. This is quite effective in putting out fires, but its high exit velocity also prevents it from being used on paper or wood fires.

A further problem with using prior art nozzles with these high vapor pressure compounds is that when they are used in a closed compartment—an aircraft cargo compartment, for example—the pressure rise in a total flood system is so sudden and so great that it can rupture the compartment because of the large volume of gas needed. Thus the cargo compartment extinguishing systems that are used on aircraft must contain Halon, which, while it is very effective and does not have the disastrous pressure rise, is damaging to the ozone layer and hence is being phased out.

Some $CO_2$ extinguisher nozzles produce a small amount of "snow", which is desirable since it slows down the high exit velocity and sudden pressure rise. However, these nozzles do not produce enough snow to allow their use either on Class A fires or in aircraft cargo compartments.

The prior art shows means for producing $CO_2$ snow or "dry ice" which is used for preserving perishables wherein the liquid $CO_2$ undergoes an expansion and then passes over the inlet for the liquid $CO_2$ (see, for example, U.S. Pat. No. 4,145,894). However, this does not convert enough liquid $CO_2$ to snow to reduce the exit velocity if it were used as a fire extinguisher.

OBJECTS OF THE PRESENT INVENTION

Accordingly, it is an object of the present invention to provide a nozzle for use on a fire extinguisher that can be used with high room temperature vapor pressure compounds.

It is a further object to provide such a nozzle that does not have an objectionably high exit velocity.

It is a further object to provide such a nozzle that can be used in a substantially closed compartment.

It is a further object of the present invention to provide such a nozzle that produces a mixed gas/solid output or low pressure gas/liquid output.

SUMMARY

Briefly, the present invention is a nozzle for a fire extinguisher that allows the use of fire-fighting liquids that have a high room temperature vapor pressure. It comprises a primary expansion stage and one or more secondary expansion stages for the liquid, with the flow being redirected after each secondary expansion stage so that it goes over the conduit that comprises the previous expansion stage. As it goes over the conduit it extracts heat from the flow within the conduit. Thus the flow is cooled by expansion in each stage as well as by heat transfer from stage to stage; during this process it becomes a mixed gas/liquid/solid flow. The flow from the last secondary expansion stage also comes in contact with the inlet conduit into the nozzle. After a number of stages, the flow has been cooled down to the point where a large part of it becomes a solid in the case of $CO_2$, and the flow exits the nozzle as a low-velocity mix of gas and solid particles. In the case of HFC-23, the liquid is chilled to the point that the flow exits the nozzle as a low pressure aerosol.

DESCRIPTION OF THE PREFERRED EMBODIMENT

Figure 1:
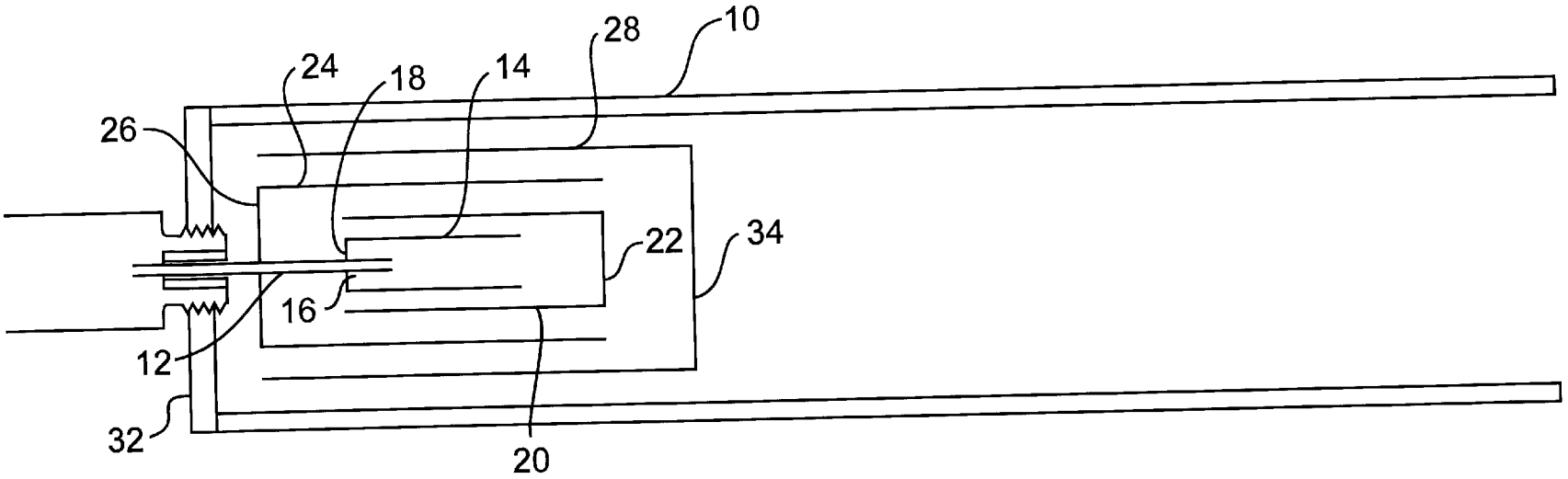
FIG. 1 shows a cross section of the nozzle of the present invention for use with $CO_2$.

As shown in FIG. 1, a nozzle for use with $CO_2$ according to the present invention comprises an outer housing 10 surrounding a series of expansion stages for the $CO_2$. Outer housing 10 also comprises the conduit for the final expansion of the liquid. The liquid enters the nozzle through conduit 12, then as it exits conduit 12 into primary expansion conduit 14 it expands since the cross-sectional area of conduit 14 is larger than the cross-sectional area of conduit 12. As can be seen there is a volume 16 approximately ¼ inch deep behind the exit from conduit 12 formed by end wall 18 on conduit 14; this volume aids in the expansion of the liquid and produces a larger yield of desired products. The flow then expands into secondary expansion stage conduit 20, where it cools further. Conduit 20 is closed at its end by end wall 22, which causes the flow to reverse direction and pass back over conduit 14. As the flow passes back over conduit 14 it extracts heat from the flow in conduit 14.

The flow exits from conduit 20 into another secondary expansion stage, conduit 24, where it expands again and cools further and is caused to reverse direction again by end wall 26 on conduit 24. It then passes over conduit 20, where it extracts heat from the flow in conduit 20.

The flow goes through another expansion into conduit 28 and reversal where it cools and reverses direction, again passing over the conduit which forms the previous expansion stage and extracting heat from that stage. During each expansion more of the liquid is converted to a gas or a solid, with the flow being a mixture of varying proportions of liquid, gas, and solid. This mixture passes over the conduit which forms the previous stage and extracts heat from that stage. After the final expansion out of conduit 28, however, it also comes in contact with conduit 12 which forms the inlet to the nozzle, thereby exposing the inlet flow to the temperature created by the last of the expansions.

Figure 7:
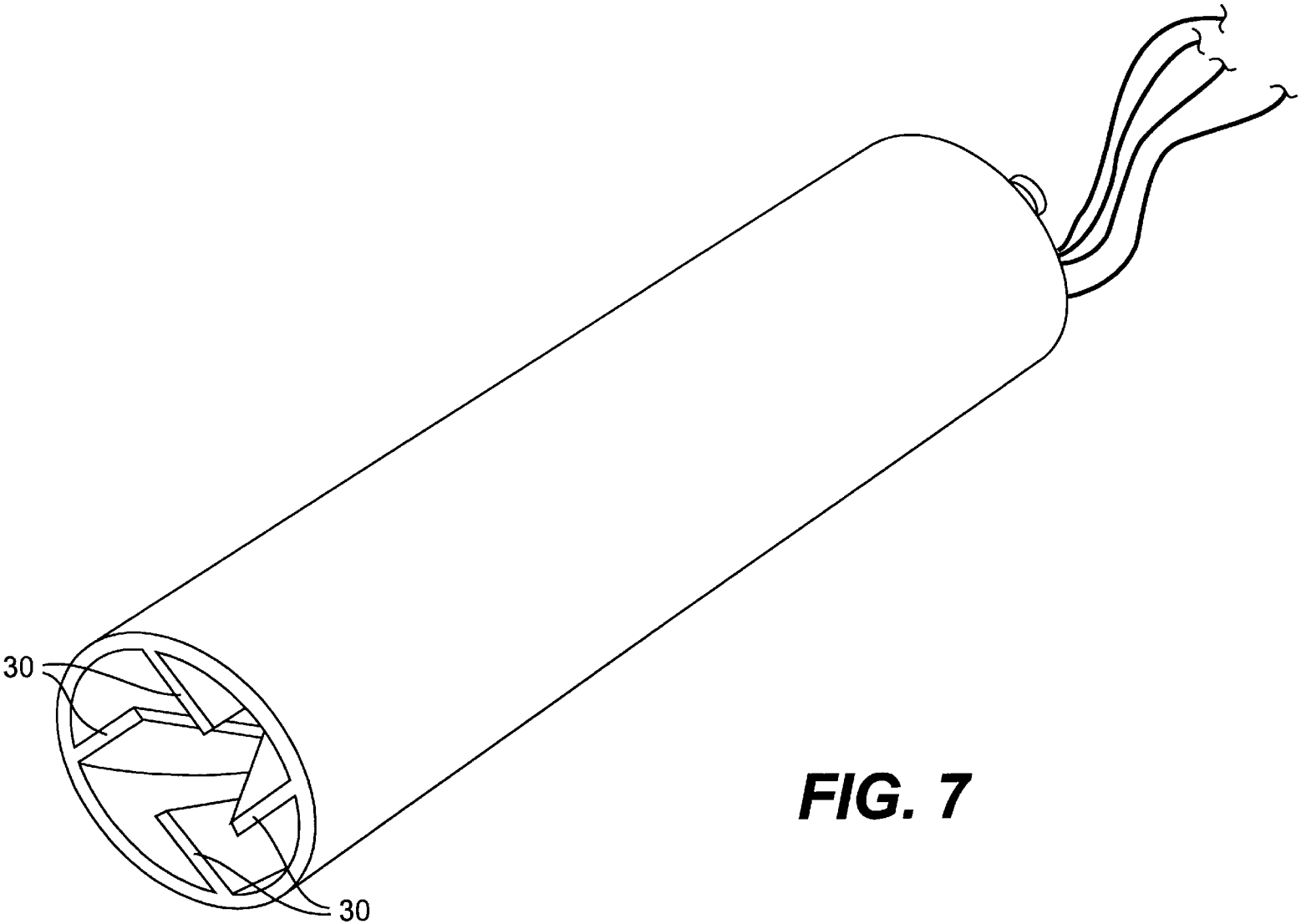
FIG. 7 shows a flow concentrator at the exit of the nozzle which directs flow toward the axis of the nozzle.

Additionally, it was found that the addition of means to focus the flow toward the centerline of the exit nozzle increased the size of the dry ice particles when using $CO_2$. This was done by adding vanes 30 to the inside of outer housing 10 as shown in FIG. 7. Vanes 30 are mounted to the inside of outer housing 10 at an angle to its centerline and direct the flow toward its centerline, thereby focusing the outlet flow. This causes additional turbulence in the flow which takes work out of the flow, thereby lowering its temperature to−82 degrees C. which is below the temperature of solid $CO_2$ at room pressure (i.e.−76 C).

The flow reversals inside the nozzles also cause turbulence in the flow, taking work out of the flow and contributing to the lowering of the temperature of the flow.

Since it is desirable that heat be transferred from one stage to the next, the conduits within the nozzle are preferably made of a material having good thermal conductivity such as brass. The outer housing, however, should be made of a material having a low thermal conductivity since it is desirable that the flow remain as cold as possible as long as it is within the nozzle.

Thus the liquid, rather than entering the series of expansions at room temperature, enters the series of expansions at a very low temperature. After it goes through an expansion, each of which except the first passes over the conduit from which it most recently exited, it extracts heat from the flow in the conduit from which it most recently exited. Since the inlet flow is exposed to the temperature of the flow after the final expansion into outer housing 10, there is very little heat to be extracted from the incoming liquid by the expansions. The result is a very rapid and efficient conversion of the liquid $CO_2$ to solid particles or snow, as evidenced by the steep temperature drops in FIGS. 3 and 4.

The nozzle for use with $CO_2$ shown in FIG. 1 had an overall expansion ratio of approximately 325, broken down as follows: the first expansion ratio into conduit 14 was 10.60; the second expansion ratio into conduit 20 (the first with flow reversal) was 1.05; the third expansion ratio into conduit 24 (and second flow reversal) was 4.02; the fourth expansion ratio into conduit 28 (and third flow reversal) was 1.57; the fifth expansion ratio into the rear of outer housing 10 (and final flow reversal) was 2.27; and the sixth expansion ratio as the flow cleared the internal conduits was 2.04. The overall length of the nozzle (i.e. outer housing 10) was chosen to be 8 inches, the same as a conventional $CO_2$ fire extinguisher nozzle, in order to eliminate any effects due to a different nozzle length.

In this nozzle conduit 12 was ⅛ inch brass tubing that projected approximately ¼ inch beyond end wall 18; conduit 14 was 11/32 inch brass tubing one inch long; conduit 20 was ½ inch brass tubing 11½ inches long; conduit 24 was ⅞ inch brass tubing 2 inches long; conduit 28 was 1¼ inch brass tubing 21½ inches long; and outer housing 10 was 2 inch O.D. phenolic tubing 8 inches long with ⅛ inch wall thickness. All internal tubing was 1/64 inch wall tubing. End wall 26 was approximately ¼ inch from end wall 32; end wall 34 was approximately ½ inch from end wall 22; and end wall 18 was approximately ½ inch from end wall 26. All end walls were of minimum thickness brass sheet. The concentric conduits were held in place by short sections of minimum wall thickness brass tubing (not shown) of the proper diameter that were epoxied in place. The overall expansion ratio of the nozzle was approximately 325.

Figure 2:
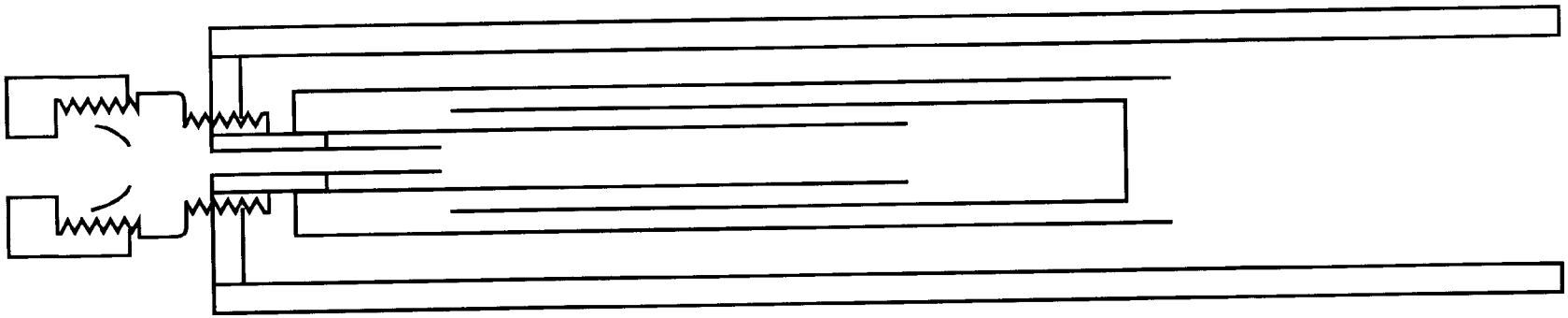
FIG. 2 shows a cross section of the nozzle of the present invention for use with HFC-23.

FIG. 2 shows a nozzle according to the present invention for use with HFC-23 (trifluoromethane). It utilizes the same principles, but has two fewer expansion stages (i.e. 4 expansions instead of 6). It was found that 6 expansions of HFC-23 reduced the effectiveness of the nozzle as a fire extinguishing nozzle, hence this nozzle has only 4 expansion stages and 2 flow reversals. In fact, with 6 expansions HFC-23 came out of the nozzle as a liquid at practically zero velocity; reducing the number of expansions to 4 caused it to exit as a low pressure aerosol, which made it a desirable fire-fighting nozzle. The fact that the internal conduits are longer in this nozzle than in the $CO_2$ nozzle results from the fact that this nozzle was the first one developed, before an attempt was made to optimize the length of the internal conduits as was done with the $CO_2$ nozzle of FIG. 1. The length of the outer conduit is arbitrary; it does not match the length of an existing HFC nozzle as was done with the $CO_2$ nozzle.

Figure 3:
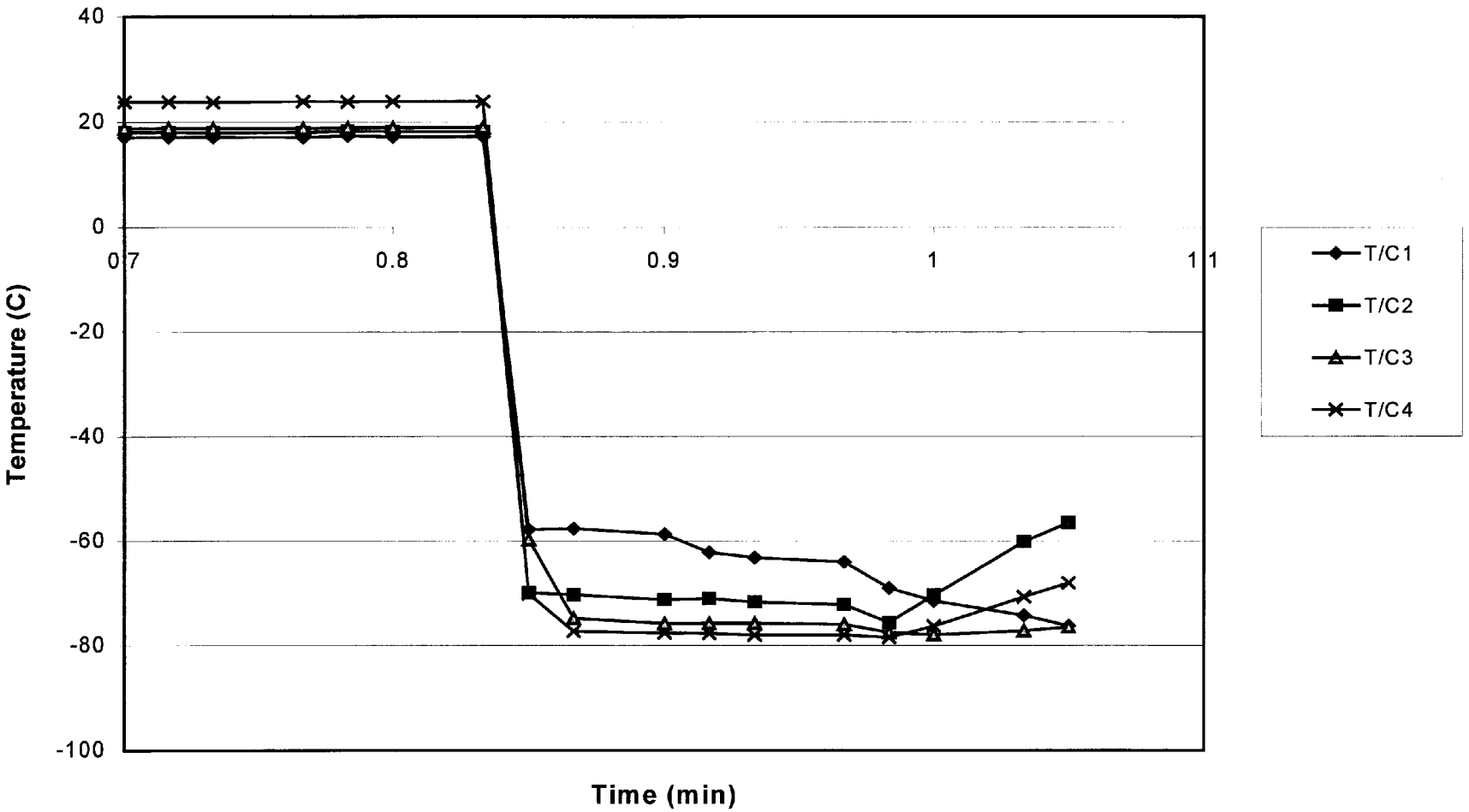
FIG. 3 shows a temperature profile measured within the nozzle of FIG. 1.
Figure 4:
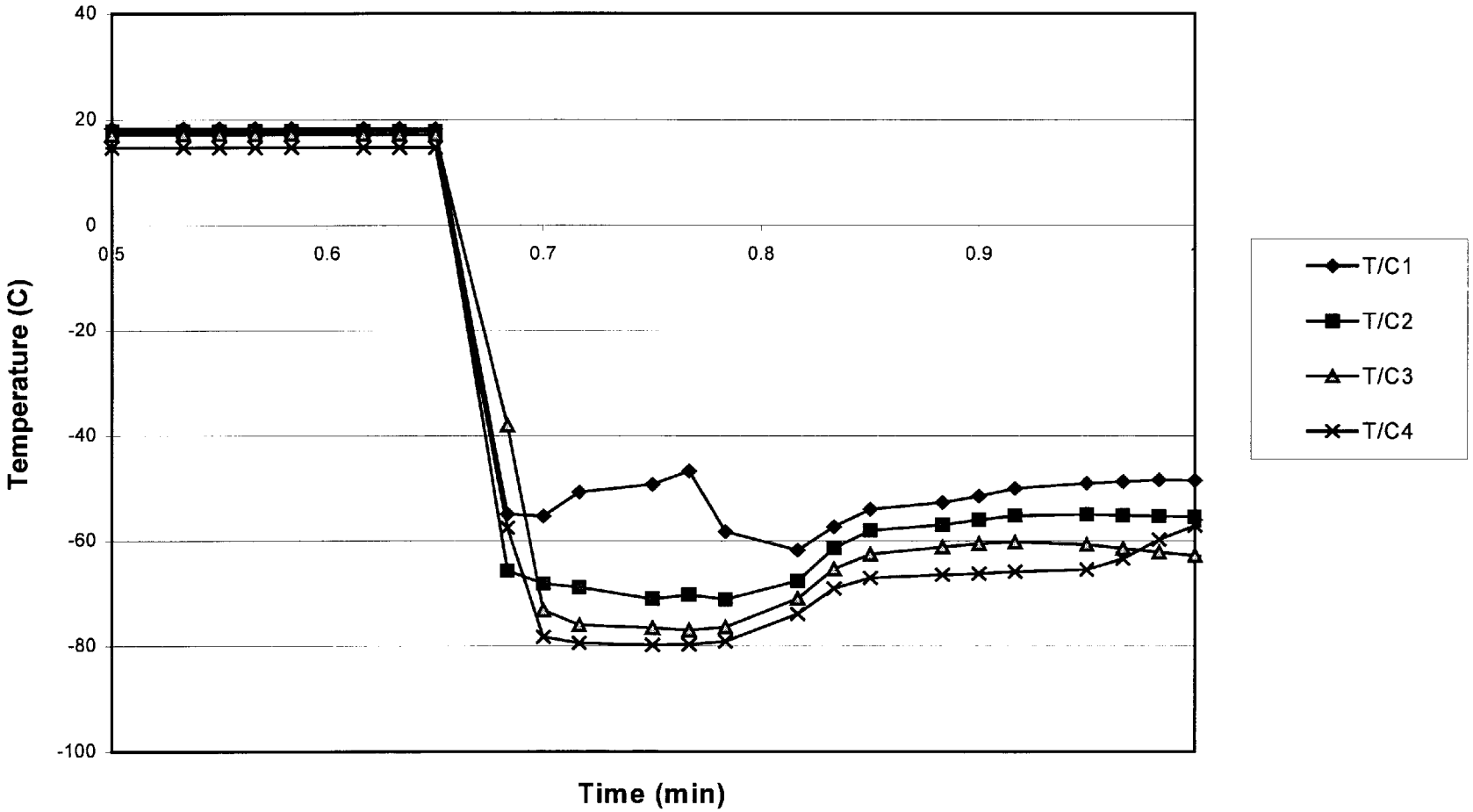
FIG. 4 shows a temperature profile measured within the nozzle of FIG. 1.

FIGS. 3 and 4 show representative temperature profiles for the nozzle of FIG. 1 (i.e. $CO_2$ as the fire-fighting fluid). $T_1$, $T_2$, $T_3$, and $T_4$ are the temperatures measured at the points of the first, second, third, and fourth flow reversals, respectively. As can be seen, $T_4$, the temperature at the last reversal, is the lowest of the temperatures and remains fairly constant at somewhat below −80 degrees C. in FIG. 4 and somewhat below −90 degrees C. in FIG. 3. The fluctuations in the other temperatures are not understood at this time. The variations between the profiles of FIGS. 3 and 4 are thought to be experimental error.

Figure 5:
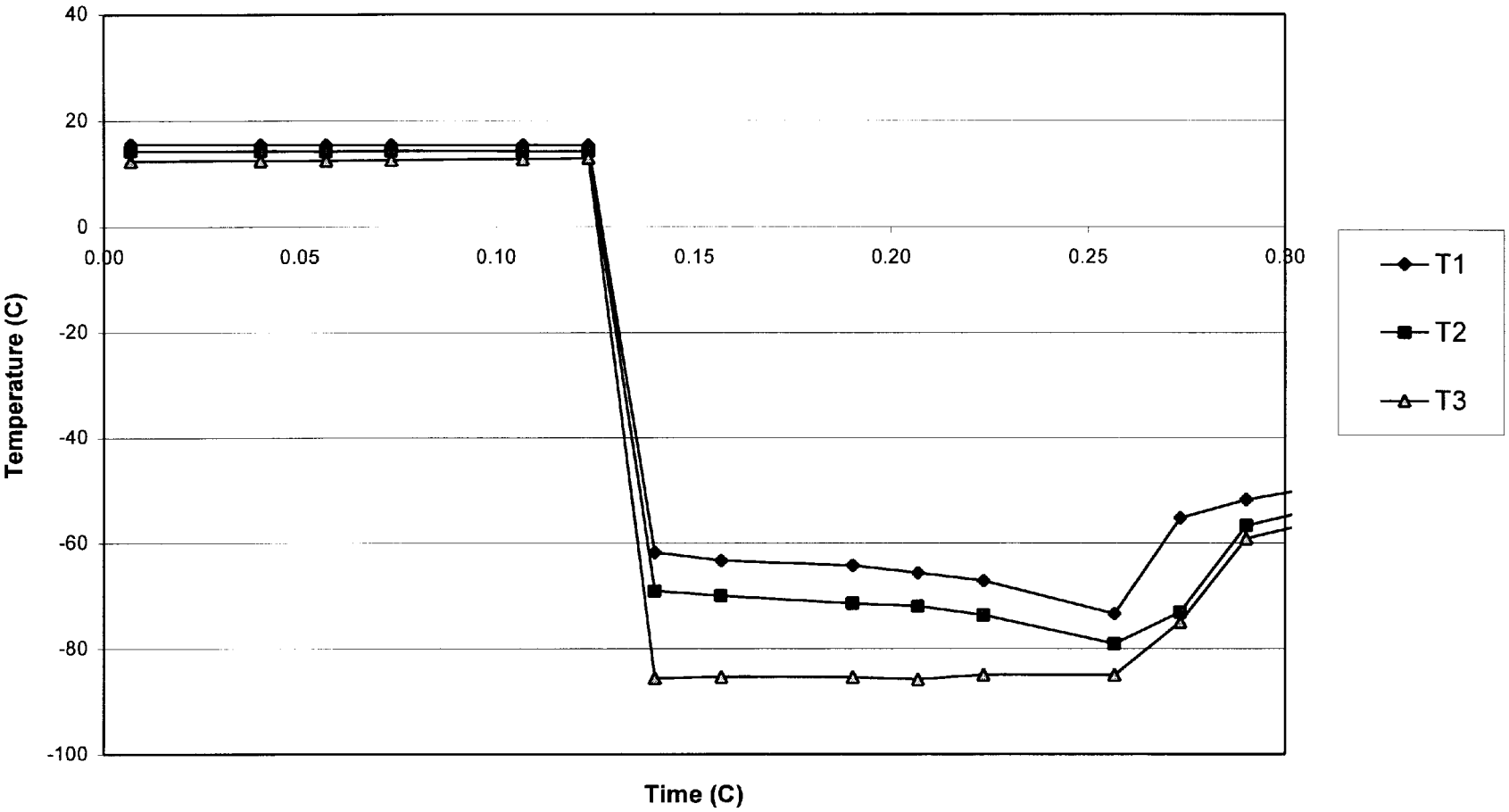
FIG. 5 shows a temperature profile measured within the nozzle of FIG. 2.
Figure 6:
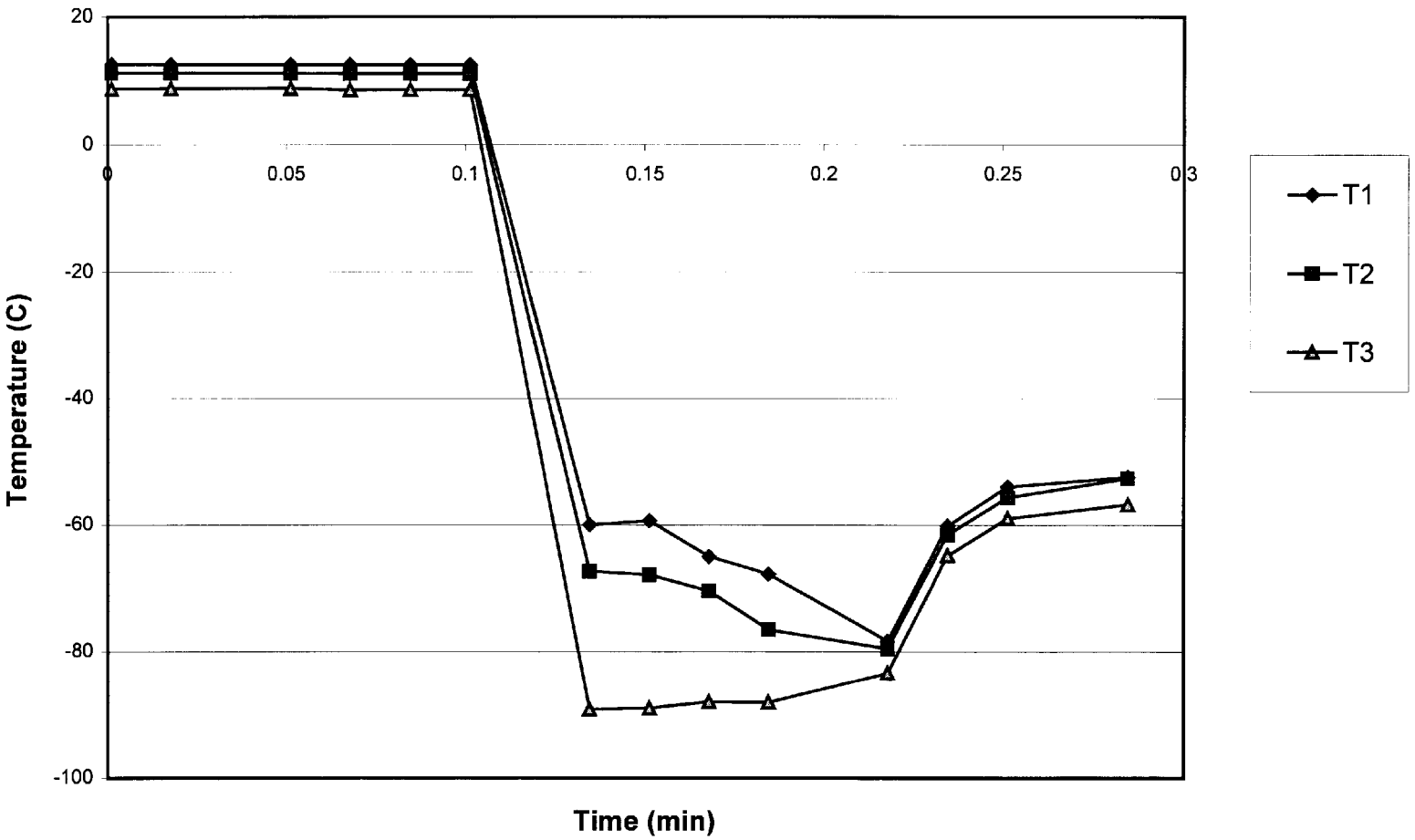
FIG. 6 shows a temperature profile measured within the nozzle of FIG. 2.

FIGS. 5 and 6 show representative temperature profiles for the nozzle of FIG. 2 (i.e. HFC-23 as the fire-fighting fluid). $T_1$ and $T_2$ are the temperatures measured at the points of the first and second flow reversals, respectively. $T_3$ is the temperature measured at the exit of the last expansion into the outer housing; it is the lowest and remains fairly consistant at approximately −90 degrees C. The reason that these temperature profiles do not exhibit the variations of the corresponding temperature profiles in the nozzle of FIGS. 3 and 4 is not known at this time.

In FIGS. 3–6 the initial constant temperature portions of the curves are due to the time interval between turning on the instrumentation and opening the valve to start the flow of fluid, which was done to establish baseline conditions. Once the fluid began to flow the temperature dropped almost instantly. Likewise, the increase in temperatures at the end of the run in FIGS. 5 and 6 is due to the interval between exhaustion of the fluid and turning off of the instrumentation. There were no vanes in the nozzles used in these figures; the temperature of $CO_2$ snow produced by a nozzle with vanes was determined by using such a nozzle to produce a pile of $CO_2$ snow on the ground and measuring its temperature with a thermocouple.

Initially it was thought that the internal conduits should be made fairly long, in order to promote maximum heat exchange. However, subsequent testing showed that shorter conduits were better; therefore it is thought that the conduits should be made as short as practicable from a manufacturing standpoint. No attempt was made to optimize the length of outer housing 10 or the expansion ratios between stages.

Because of the efficient conversion of liquid $CO_2$ to solid, the exit velocity is low. This allows a $CO_2$ extinguisher having a nozzle of the present invention to be used on a Class A fire since the low exit velocity will not scatter burning pieces of paper or wood. Two standard 5 pound $CO_2$ extinguishers, one with a prior art nozzle and one equipped with a nozzle of the present invention, were tested on a standard Underwriter's Lab Class 1A fire (wood crib, 50 pieces of 2 by 2 wood ignited with 1 liter of heptane, 8 minutes preburn). The extinguisher with the prior art nozzle was completely unsuccessful; it fanned the fire, scattering ash approximately 6 feet, with no reduction in the size or intensity of the fire. The extinguisher having a nozzle of the present invention did not scatter the fire and reduced the size of the fire. Some deposition of $CO_2$ snow on the top members of the crib was seen, although the extinguisher was emptied before the fire was completely put out.

While shown herein as having four secondary expansion stages for $CO_2$ and three for HFC-23, the present invention contemplates the use of as many secondary expansion stages as are necessary to achieve the degree of cooling desired. Thus in practice, depending on the liquid used and the outlet flow conditions desired, there may be more or fewer than the number of secondary expansion stages shown herein.

Likewise, while shown herein as being used with $CO_2$ and HFC-23, the nozzle of the present invention can be used with any liquid having a very high vapor pressure at room temperature, and for purposes other than fire fighting.

The nozzle of the present invention can also be used to produce solid blocks of the liquid for whatever purpose desired. That is, rather than directing the $CO_2$ snow produced by the nozzle at a fire, the snow could be directed into a collecting chamber and then formed into blocks of dry ice as is well known in the art.

I claim:

1. A nozzle for converting a liquid having a high room temperature vapor pressure to a continuous mixed gas/solid or gas/liquid stream which comprises an inlet conduit for said liquid, said inlet conduit directing said liquid into a primary expansion stage where said liquid undergoes a first expansion, and one or more secondary expansion stages, each of said secondary expansion stages comprising a conduit which causes said expanded liquid to reverse direction and flow over the outside of the conduit from which it most recently exited, and an outer housing for said nozzle surrounding said expansion stages.

2. A nozzle as in claim 1 wherein said conduits are concentric.

3. A nozzle as in claim 2 wherein said expanded liquid from the final expansion stage contacts said inlet conduit.

4. A nozzle as in claim 3 further including means in said outer housing to focus said expanded liquid toward the centerline of said nozzle.

5. A nozzle as in claim 4 wherein said means to focus comprises vanes attached to the inside of said nozzle outer housing.

6. A nozzle as in claim 2 wherein said conduits are made of a material having a high thermal conductivity.

7. A nozzle as in claim 6 wherein the outer housing for said nozzle is made of a material having a low thermal conductivity.

8. A nozzle as in claim 6 wherein said material is brass.

9. A nozzle as in claim 2 wherein said liquid is HFC-23.

10. A nozzle as in claim 2 wherein said liquid is liquid $CO_2$.

11. A nozzle as in claim 2 wherein said vapor pressure is 500–800 psi.

12. The method of creating a continuous mixed gas/solid or gas/liquid stream from a liquid having a high room temperature vapor pressure which comprises introducing said liquid into a first conduit, causing said liquid to undergo a first expansion while flowing in a first direction, causing said expanded liquid to reverse direction one or more times and undergo another expansion in another conduit each time it reverses direction, and after each reversal of flow direction causing said expanded liquid to flow over the outside of the conduit from which it most recently exited.

13. The method of claim 12 further including aligning said conduits concentrically with one another.

14. The method of claim 13 further including contacting said first conduit with the expanded liquid from the last of said expansions.

15. The method of claim 14 further including focusing said expanded liquid toward the centerline of the last of said expansion conduits.

16. The method of claim 14 further including constructing all but the last of said conduits of a material having a high thermal conductivity.

17. The method of claim 16 further including constructing the last of said conduits of a material having a low thermal conductivity.

18. The method of creating a continuous mixed gas/solid or gas/liquid stream from a liquid having a high room temperature vapor pressure which comprises flowing said liquid in a first conduit and causing said liquid to undergo an expansion by flowing into a larger conduit, causing said expanded liquid to reverse its direction of flow one or more times and each time undergo another expansion into a larger conduit prior to said flow reversal, and after each expansion causing said expanded liquid to flow over the outside of the conduit from which it most recently exited.

19. The method of claim 18 further including aligning said conduits concentrically with one another.

20. The method of claim 19 further including contacting said first conduit with the expanded liquid from the last of said series of expansions.

21. The method of claim 20 further including constructing all but the last of said conduits of a material having a high thermal conductivity.

22. The method of claim 21 further including constructing the last of said conduits of a material having a low thermal conductivity.

* * * * *